United States Patent [19]

King

[11] Patent Number: 4,965,001

[45] Date of Patent: Oct. 23, 1990

[54] LUBRICATION BLENDS

[75] Inventor: James P. King, Lansdale, Pa.

[73] Assignee: Atochem North America, Inc., Philadelphia, Pa.

[21] Appl. No.: 346,102

[22] Filed: May 2, 1989

[51] Int. Cl.[5] ..... C10M 125/10; C10M 125/22

[52] U.S. Cl. ..... 252/30; 252/25; 252/28; 501/12; 501/25

[58] Field of Search ..... 501/25, 12; 252/25, 252/27, 28, 30

[56] References Cited

U.S. PATENT DOCUMENTS

| | | | |
|---|---|---|---|
| 3,313,729 | 4/1967 | Glasson | 252/18 |
| 3,965,016 | 6/1976 | Souley | 252/25 |
| 4,465,604 | 8/1984 | King | 252/37.2 |
| 4,557,839 | 12/1985 | Tubbs et al. | 252/23 |
| 4,663,060 | 5/1987 | Holinski | 252/12 |
| 4,741,845 | 5/1985 | King | 252/18 |

*Primary Examiner*—Jacqueline V. Howard

*Attorney, Agent, or Firm*—Seidel, Gonda, Lavorgna & Monaco

[57] ABSTRACT

A novel lubrication blend useful per se as a lubricant or as an additive to form a novel lubricant composition. The lubrication blend consists essentially of a mixture of: (1) at least one complex sulfide of antimony, represented by the formula:

$$Sb_xS_y$$

wherein, x is a number in the range from about 1.7 to about 2.3, and y is a number in the range from about 3.6 to about 4.4, (2) at least one antimony oxide, and (3) at least one lamellar crystalline solid lubricant.

27 Claims, No Drawings

LUBRICATION BLENDS

FIELD OF THE INVENTION

This invention relates to lubrication blends. These lubrication blends can be useful per se as lubricants or as additives to form lubricant compositions.

BACKGROUND OF THE INVENTION

It is known that certain materials of lamellar crystalline structure (e.g., molybdenum disulfide and graphite) can impart desirable lubricating properties to greases, solid films and other configurations in which they are employed. For example, U.S. Pat. No. 3,935,114 discloses the use of molybdenum disulfide and a selected class of a metallic oxide (e.g., antimony trioxide) in effective and synergistic amounts as lubricant additives. Moreover, U.S. Pat. No. 4,557,839 discloses, among other things, the use of mixtures of molybdenum disulfide or graphite or mixtures thereof with antimony thioantimonate in effective and synergistic amounts as lubricant additives.

While the above additives perform satisfactorily, there is a continuing desirability to further improve the physical characteristics of lubricants. Therefore, it is an object of this invention to provide a lubrication blend which has such improved lubrication characteristics or which is useful as an additive to form a lubrication composition having improved lubrication characteristics.

Other aspects, concepts and objects of this invention will become apparent from the following Detailed Description and appended claims.

SUMMARY OF THE INVENTION

The invention is directed to lubrication blends which can be useful per se as lubricants or as additives to form lubricant compositions.

The invention comprises a novel lubrication blend which consists essentially of a mixture of: (1) at least one complex sulfide of antimony, represented by the formula:

$$Sb_xS_y$$

wherein, x is a number in the range from about 1.7 to about 2.3, and y is a number in the range from about 3.6 to about 4.4, (2) at least one antimony oxide, and (3) at least one lamellar crystalline solid lubricant.

When used as a lubricant additive, to form a novel lubricant composition, the novel lubrication blend is mixed with a lubricant base. When mixed with a lubricant base, the lubrication blend is present in an amount ranging from about 0.03 to about 40 weight percent, based on the total weight of the lubricant composition formed.

DETAILED DESCRIPTION OF THE INVENTION

Lubricants have many uses in industry. In order to satisfy the specific lubricant needs of the ultimate user, it is often necessary for the lubricant to retain certain performance characteristics. A lubricant's performance characteristics are often measured in terms of FourBall Scar Diameter, Load Wear Index, and Weld Point. Although each of these characteristics has associated therewith desirable levels, the specific needs of the lubricant user may require that only one of these characteristics fall within a desirable range. Therefore, a lubricant which has or results in any one of these characteristics being improved is desirable.

As used herein, the phrase "Four-Ball Scar Diameter" refers to an average scar diameter obtained on steel balls by the test method which is used for determining the wear preventative characteristics of greases in sliding steel-on-steel applications. The test conditions employed to determine the Scar Diameter are 75° C., 1200 rpm, 40 kg for 1 hour. (see, ASTM-D-2266-86).

As used herein the phrase "Four-Ball Load Wear Index" refers to an index of the ability of a lubricant to prevent wear at applied loads. Under the conditions of this test, specific loadings in kilogram-force, having intervals of approximately 0.1 logarithmic units, are applied to the three stationary balls for ten runs prior to welding. (see, ASTM-D-2596-87).

As used herein the phrase "Four-Ball Weld Point" refers to the lowest applied load, in kilogram-force, at which the rotating ball seizes and then welds to the stationary balls. This indicates that the extreme-pressure level of the lubricating grease has been exceeded. (see, ASTM-D-2596-87).

The novel synergistic lubrication blend of this invention consists essentially of a mixture of: (1) at least one complex sulfide of antimony, represented by the formula:

$$Sb_xS_y$$

wherein, x is a number in the range from about 1.7 to about 2.3, and y is a number in the range from about 3.6 to about 4.4, (2) at least one antimony oxide, and (3) at least one lamellar crystalline solid lubricant.

The complex sulfide of antimony can be any suitable antimony compound which imparts extreme pressure and antiwear properties either alone or when combined with a lubricant base. One example of a suitable complex sulfide of antimony is antimony thioantimonate ($SbSbS_4$).

The antimony oxide component of the novel lubrication blend can be any suitable antimony oxide which, when mixed with the complex sulfide of antimony or with the lamellar crystalline solid lubricant or with both, synergistically improves at least one of the following performance characteristics: Scar Diameter, Load Wear Index and/or Weld Point. Examples of suitable antimony oxides include, but are not limited to, antimony trioxide, antimony tetroxide, antimony pentoxide, and/or mixtures thereof. It is presently preferred that the antimony oxide component comprises antimony trioxide.

The weight ratio between the complex sulfide of antimony and the antimony oxide generally ranges from about 1:0.1 to about 1:10, preferably, from about 1:0.2 to about 1:8, and more preferably, from about 1:0.3 to about 1:5.

The lamellar crystalline solid lubricant component of the novel lubrication blend can be any suitable lamellar lubricant which, when mixed with the complex sulfide of antimony, or with the antimony oxide, or with both, synergistically improves at least one of the following performance characteristics: Scar Diameter, Load Wear Index and/or Weld Point. Examples of suitable lamellar crystalline solid lubricants include, but are not limited to, molybdenum disulfide, graphite, graphite fluoride,, niobium diselenide, tungsten disulfide, tungsten diselenide, lead sulfide, lead oxide, calcium fluoride-barium fluoride eutectic mixtures, and/or mixtures thereof. It is presently preferred that the lamellar crystalline solid lubricant component comprises molybdenum disulfide and/or graphite.

The individual components of the novel lubrication blend can be incorporated into the blend in any suitable form. It is presently preferred that the components are particulate (i.e., finely divided powder having a particle size in the range from about 0.01 to about 100 microns, preferably from about 0.1 to about 10 microns).

The novel lubrication blend of the invention is useful for lubricating the contacting surfaces of a wide variety of materials, for example, metals, alloys, ceramics, plastics, cements and other materials, wherein the contacting surfaces may be of the same or different materials.

The lubrication blend may be applied to the surface requiring lubrication either alone or in combination with other solid lubricants. The novel lubrication blend may also be held closely adjacent to the contacting surfaces with a resin-type binder. It can also be incorporated directly to the surface with a pigment.

Numerous applications with respect to virtually any type of surface requiring lubrication are possible. For example, the blend may be applied to sliding surfaces in an automobile sun roof (where grease should be avoided). Specifically, the novel lubrication blend can be either resin bound to the surface of the tracks or incorporated within the surface in a pigment-like fashion.

As stated above, it is also within the scope of the invention to combine the novel lubrication blend with a lubricant base to form a novel lubricant composition. Any suitable lubricant base can be used. Examples of such lubricant bases include, but are not limited to, greases, mineral oils of lubricating viscosity, synthetic fluids of lubricating viscosity, resin-bonded solid lubricant, and/or mixtures thereof. The lubricant base may further include antioxidants, anticorrosives, and/or other additives.

Examples of greases which can be employed as the lubricant base include, but are not limited to, calcium-containing greases, lithium-containing greases, natural petroleum greases, silicone greases comprising a silicone oil containing a thickening agent (e.g., tetrafluoroethylene polymers and copolymers), fluoropolymers, fumed silica, and/or mixtures thereof.

Examples of synthetic fluids having a lubricating viscosity which can be employed as the lubricating base include, but are not limited to, dioctyl sebacate, dioctyl adipate, tributyl phosphate, 2,2-diethyhexyl sebacate, ditridecyl phthalate, ditridecyl adipate, dioctyl dimerate, trimethylolpropane tripelargonate, pentaerythrothol tetravalerate, triaryl phosphate, polyalkyene ethers, polyalphaolefins, and the like, and/or mixtures thereof. The synthetic fluids can optionally, and often do, include a thickener. Examples of such thickeners include, but are not limited to, lithium stearate, aluminum stearate, lithium hydroxy stearate, calcium stearate, silica, clay, hydroxyaluminum benzoate stearate, polyureas, and the like and/or mixtures thereof.

When combining the novel lubrication blend with a lubricant base, it is presently preferred that the lubricant base include a calcium-containing grease or a lithium-containing grease.

The weight ratio, in the novel lubricant composition, of the lubricant base to the lubrication blend, generally ranges from about 60:40 to about 99.97:0.03, preferably from about 70:30 to about 99.85:0.15, and more preferably, from about 80:20 to about 99.7:0.3.

When combined with a lubricant base to form a novel lubricant composition, the complex sulfide of antimony component of the lubrication blend is generally present in an amount less than about 4 weight percent but greater than about 0.01 weight percent, based on the total weight of the novel lubricant composition formed. Preferably, the complex sulfide of antimony is present in an amount ranging from about 0.05 to about 3 weight percent, more preferably, in an amount from about 0.1 to about 2 weight percent.

In this latter embodiment, the antimony oxide component of the novel lubrication blend is generally present in an amount ranging from about 0.01 to about 20 weight percent, preferably from about 0.05 to about 15 weight percent, and more preferably from about 0.1 to about 10 weight percent. These weight percentages are based on the total weight of the novel lubricant composition formed.

Also when practicing this latter embodiment, the lamellar crystalline solid lubricant component of the novel lubrication blend is generally present in an amount ranging from about 0.01 to about 20 weight percent, preferably from about 0.05 to about 18 weight percent, and more preferably from about 0.1 to about 15 weight percent. These weight percentages are also based on the total weight of the novel lubricant composition formed.

It is presently preferred, when preparing a lubricant composition in accordance with the invention, that the components of the lubrication blend are initially mixed together to provide a pre-mix. This pre-mix is thereafter combined with the lubricant base to form the novel lubricant composition.

The invention will be more fully understood from the following examples. The examples are only intended to demonstrate select embodiments of the invention and are in no way intended to limit the scope thereof.

EXAMPLE 1

This Example demonstrates the preparation and evaluation of lubricant compositions comprising a lithium-containing lubricant base and a lubricant blend as an additive.

A lubricant composition was prepared in accordance with the invention by thoroughly mixing 99 grams of a lithium grease, as the lubricant base, with 1 gram of a lubricant additive. The lithium grease was derived from a mineral oil base fluid thickened with 12-hydroxysterate. The lubricant additive used in the preparation of this sample was a blend of 0.33 grams of molybdenum disulfide ($MoS_2$), 0.33 grams of antimony trioxide ($Sb_2O_3$), and 0.33 grams of antimony thioantimonate ($SbSbS_4$). Henceforth, this lubricant composition will be referred to as Sample 1.

The weight percentage, of the lubricant additive in the resulting lubricant composition, is recorded in TABLE I. The weight ratio, of the individual components making up the lubricant additive to one another, is also recorded in TABLE I. The observed Weld Point, Scar Diameter, and Load Wear Index of Sample 1 are recorded in Table II.

Four additional samples of the inventive lubricant composition were prepared. These samples are hereinafter referred to as Samples 2–5, inclusive. The only significant difference between Samples 2–5 and Sample 1 was the relative weight ratio of the lubricant additive components between one another. For example, in Sample 2, the lubricant additive was prepared by premixing 0.25 grams of $MoS_2$, 0.25 grams of $Sb_2O_3$ and 0.50 grams of $SbSbS_4$, thus resulting in a weight ratio of $MoS_2$:$Sb_2O_3$: $SbSbS_4$ of 1:1:2. Similarly, the lubricant additive in Sample 3 was prepared by premixing 0.55 grams of $MoS_2$, 0.25 grams of $Sb_2O_3$ and 0.20 grams of $SbSbS_4$. The lubricant additive for Sample 4 were prepared by premixing 0.25 grams of $MoS_2$, 0.10 grams of $Sb_2O_3$, and 0.65 grams of $SbSbS_4$. Finally, the lubricant additive of Sample 5 was prepared by premixing 0.5 grams of $MoS_2$, 0.5 grams of $Sb_2O_3$, and 0.5 grams of $SbSbS_4$.

The weight percentages, of the lubricant additives in the resulting lubricant compositions, are recorded in TABLE I. The weight ratios, of the individual components making up the lubricant additives to one another, are also recorded in TABLE I.

The Scar Diameter of Samples 2, 3 and 5 were evaluated by the same method as that used for Sample 1. The Weld Point and Load Wear Index of Samples 4 and 5 were evaluated by the same method as that used for Sample 1. The observed data for Samples 2–5 are recorded in Table II.

To demonstrate the effectiveness of the invention, six control samples (i.e., Samples 6–11, inclusive) were prepared and evaluated. The only significant difference between Samples 6–11 and Sample 1 was the composition of the lubricant additive. Specifically, the lubricant additive of Sample 6 consisted of 1.0 grams of $MoS_2$; the lubricant additive of Sample 7 consisted of 1.0 grams of $Sb_2O_3$ the lubricant additive of Sample 8 consisted of 1.0 grams of $SbSbS_4$; the lubricant additive of Sample 9 consisted of 0.5 grams of $MoS_2$ and 0.5 grams of $Sb_2O_3$; the lubricant additive of Sample 10 consisted of 0.5 grams of $Sb_2O_3$ and 0.5 grams of $SbSbS_4$; and, the lubricant additive of Sample 11 consisted of 0.5 grams of $Sb_2O_3$ and 0.5 grams of $SbSbS_4$.

The weight percentages, of the lubricant additives in the resulting lubricant compositions, are recorded in TABLE I. The weight ratios, of the individual components making up the lubricant additives to one another, are also recorded in TABLE I.

The Weld Point characteristic of Samples 6–10 were evaluated by the same method as that used for Sample 1. The Scar Diameter and Load Wear Index of Samples 6, 9, 10 and 11 were evaluated by the same method as that used for Sample 1. The observed data for Samples 6–11 are recorded in TABLE II.

TABLE I

| Sample No. | Lubricant Additive Components Of Lithium-Based Lubricant Compositions: Weight Percentages[a] $MoS_2$ | $Sb_2O_3$ | $SbSbS_4$ | Weight Ratio $MoS_2$:$Sb_2O_3$:$SbSbS_4$ | Additive[b] (wt %) |
|---|---|---|---|---|---|
| 1 | 0.33 | 0.33 | 0.33 | 1:1:1 | 1 |
| 2 | 0.25 | 0.25 | 0.50 | 1:1:2 | 1 |
| 3 | 0.55 | 0.25 | 0.20 | 1:0.45:0.36 | 1 |
| 4 | 0.25 | 0.10 | 0.65 | 1:0.4:2.6 | 1 |
| 5 | 0.5 | 0.5 | 0.5 | 1:1:1 | 1.5 |
| 6 | 1.0 | —[c] | — | 1:0:0 | 1 |
| 7 | — | 1.0 | — | 0:1:0 | 1 |
| 8 | — | — | 1.0 | 0:0:1 | 1 |
| 9 | 0.5 | 0.5 | — | 1:1:0 | 1 |
| 10 | 0.5 | — | 0.5 | 1:0:1 | 1 |

TABLE I-continued

| Sample No. | Lubricant Additive Components Of Lithium-Based Lubricant Compositions: Weight Percentages[a] $MoS_2$ | $Sb_2O_3$ | $SbSbS_4$ | Weight Ratio $MoS_2$:$Sb_2O_3$:$SbSbS_4$ | Additive[b] (wt %) |
|---|---|---|---|---|---|
| 11 | — | 0.5 | 0.5 | 0:1:1 | 1 |

[a]"Weight Percentage" is based on the total weight of the lubricant additive.
[b]These values are the weight percentage of the lubricant additive based on the total weight of the lubricant composition.
[c]"—" indicates that no concentration of this component was present in the lubricant additive.

TABLE II

| Sample No. | Lithium-Based Evaluation of Lubricant Composition: Weld Point (kg) | Scar Diameter (mm) | Load Wear Index |
|---|---|---|---|
| 1 | 315 | 0.65 | 32.3 |
| 2 | —[a] | 0.58 | — |
| 3 | — | 0.48 | — |
| 4 | 500 | — | 55.9 |
| 5 | 400 | 0.70 | 44.0 |
| 6 | 126 | 0.73 | 17.6 |
| 7 | 200 | — | — |
| 8 | 400 | — | — |
| 9 | 200 | 0.65 | 18.8 |
| 10 | 315 | 0.71 | 34.9 |
| 11 | 400 | 0.71 | 43.6 |

[a]"—" indicate that these characteristics were not evaluated.

As stated earlier, it is desirable that the Weld Point value and the Load Wear Index value be as high as possible and that the Scar Diameter value be as low as possible.

It is appreciated from Table II that blending $MoS_2$ with the mixture of $Sb_2O_3$ and $SbSbS_4$ produces synergistic results. Specifically, when comparing inventive Sample 1 with control Sample 11, it is seen that a portion of the $Sb_2O_3$ and $SbSbS_4$ was substituted with $MoS_2$ (see. TABLE I). The weight percentage of the lubricant additive in the resulting lubricant compositions did not change between Samples 1 and 11 (i.e., lubricant additive concentration remained at 1 weight percent).

In Sample 6, wherein the lubricant additive consisted solely of 1 weight percent of $MoS_2$, the Scar Diameter value was greater than that of Sample 11, wherein the lubricant additive consisted of 0.5 weight percent $Sb_2O_3$ and 0.5 weight percent $SbSbS_4$. Therefore, it was expected that the substitution of a portion of the $Sb_2O_3$ and $SbSbS_4$ components with $MoS_2$, would increase the Scar Diameter value. However, quite unexpectedly, when substituting an amount of the $Sb_2O_3$ and the $SbSbS_4$ components with $MoS_2$, as was done in inventive Sample 1, the Scar Diameter value decreased when compared to that of control Sample 11.

Inventive Samples 2–5 demonstrate that by changing the weight percentages and weight ratios of the lubricant additive components, the characteristics of the lubricant composition can be altered. The weight percentages and ratios, demonstrated in Samples 1–5 and recorded in TABLE I, are merely a few examples of lubricant compositions encompassed by the present invention.

EXAMPLE 2

This Example demonstrates the preparation and evaluation of lubricant compositions comprising a calcium-containing lubricant base and a lubricant additive.

A calcium complex lubricant composition was prepared in accordance with the invention by thoroughly blending 89.5 grams of a calcium complex grease, as the lubricant base, with 10.5 grams of a lubricant additive. The calcium complex grease was derived from a calcium-acetate complex as a thickener in a mineral oil. The lubricant additive was prepared by blending 6.0 grams of $MoS_2$, 4.0 grams of $Sb_2O_3$, and 0.5 grams of $SbSbS_4$. Henceforth, this lubricant composition will be referred to as Sample 12.

The weight percentage, of the lubricant additive in the resulting lubricant composition, is recorded in TABLE III. The weight ratio, of the individual components making up the lubricant additive to one another, is also recorded in TABLE III.

Sample 12 was evaluated to determine its Scar Diameter value. To make this evaluation, a modified ASTM procedure was employed. Specifically, ASTM procedure D-2596 was modified to the extent that the settings on the Four-Ball E.P. Tester a load force was 300 kg, a speed of 1,800 rpm and a testing time of 5 minutes. The observed Scar Diameter value of Sample 12 is recorded in Table IV.

Seven additional samples of an inventive lubricant composition were prepared. These samples are hereinafter referred to as Samples 13–19, inclusive. The only significant difference between Samples 13–19 and Sample 12 was the relative weight ratio of the lubricant additive components between themselves and the remaining components of the lubricant composition. For example, in Sample 13, 89.0 grams of the calcium lubricant base was mixed with the lubricant additive which was prepared by blending 6.0 grams of $MoS_2$, 4.0 grams of $Sb_2O_3$, and 1 gram of $SbSbS_4$, thus resulting in a weight ratio of $MoS_2$:$Sb_2O_3$:$SbSbS_4$ of 1:0.67:0.17. Similarly, in Sample 14, 88.0 grams of the lubricant base was mixed with the lubricant additive which was prepared by blending 6.0 grams of $MoS_2$, 4.0 grams of $Sb_2O_3$ and 2.0 grams of $SbSbS_4$. In Sample 15, 87 grams of the lubricant base was mixed with the lubricant additive which was prepared by blending 7.0 grams of $MoS_2$, 5.0 grams of $Sb_2O_3$ and 1.0 grams of $SbSbS_4$. In Sample 16, 86 grams of the lubricant base was mixed with the lubricant additive which was prepared by blending 11.0 grams of $MoS_2$, 5.0 grams of $Sb_2O_3$ and 1.0 grams of $SbSbS_4$. In Sample 17, 83 grams of the lubricant base was mixed with the lubricant additive which was prepared by blending 11.0 grams of $MoS_2$, 5.0 grams of $Sb_2O_3$ and 1.0 grams of $SbSbS_4$. In Sample 18, 82 grams of the lubricant base was mixed with the lubricant additive which was prepared by blending 11.0 grams of $MoS_2$, 5.0 grams of $Sb_2O_3$ and 2.0 grams of $SbSbS_4$. Similarly, in Sample 19, 79 grams of the lubricant base was mixed with the lubricant additive which was prepared by blending 13.0 grams of $MoS_2$, 7.0 grams of $Sb_2O_3$ and 1.0 grams of $SbSbS_4$.

The weight percentages, of the lubricant additives in the resulting lubricant compositions, are recorded in TABLE III. The weight ratios, of the individual components making up the lubricant additives to one another, are also recorded in TABLE III.

The Scar Diameter value of Samples 13–19 was determined by the same method as that used for Sample 12. These observed results are recorded in TABLE IV.

To demonstrate the effectiveness of the invention in a calcium-containing grease, four control samples (i.e., Samples 20–23, inclusive) were prepared and evaluated. The only significant difference between control Samples 20–23 and inventive Sample 12 was the specific composition of the lubricant additive and the weight percentage of the additive in the resulting composition. Specifically, in Sample 20, 90 grams of the lubricant base was mixed with the lubricant additive which consisted of 6.0 grams of $MoS_2$ and 4.0 grams of $Sb_2O_3$. The lubricant composition of Sample 21 consisted of 88 grams of the lubricant base and 12 grams of the lubricant additive prepared by mixing 7.0 grams of $MoS_2$ and 5.0 grams of $Sb_2O_3$. The lubricant composition of Sample 22 consisted of 86 grams of the lubricant base and 14 grams of the lubricant additive prepared by mixing 6.0 grams of $MoS_2$, 4.0 grams of $Sb_2O_3$, and 4.0 grams of $SbSbS_4$. The lubricant composition of Sample 23 consisted of 80 grams of the lubricant base and 20 grams of the lubricant additive prepared by mixing 11.0 grams of $MoS_2$, 5.0 grams of $Sb_2O_3$, and 4.0 grams of $SbSbS_4$.

The weight percentages, of the lubricant additives in the resulting lubricant compositions, are recorded in TABLE III. The weight ratios, of the individual components making up the lubricant additives to one another, are also recorded in TABLE III.

The Scar Diameter value of Samples 20–23 was determined by the same method as that used for Sample 12. The observed data for Samples 20–23 are recorded in TABLE IV.

TABLE III

| Sample No. | Lubricant Additive Components of Calcium-Based Lubricant Compositions: Weight Percentages[a] $MoS_2$ | $Sb_2O_3$ | $SbSbS_4$ | Weight Ratio $MoS_2$:$Sb_2O_3$:$SbSbS_4$ | Additive[b] (wt %) |
|---|---|---|---|---|---|
| 12 | 6 | 4 | 0.5 | 1:0.67:0.83 | 10.5 |
| 13 | 6 | 4 | 1 | 1:0.67:0.17 | 11 |
| 14 | 6 | 4 | 2 | 1:0.67:0.83 | 12 |
| 15 | 7 | 5 | 1 | 1:0.71:0.14 | 13 |
| 16 | 7 | 5 | 2 | 1:0.71:0.29 | 14 |
| 17 | 11 | 5 | 1 | 1:0.45:0.91 | 17 |
| 18 | 11 | 5 | 2 | 1:0.45:0.18 | 18 |
| 19 | 13 | 7 | 1 | 1:0.54:0.08 | 21 |
| 20 | 6 | 4 | —[c] | 1:0.67:0 | 10 |
| 21 | 7 | 5 | — | 1:0.71:0 | 12 |
| 22 | 6 | 4 | 4 | 1:0.67:0.67 | 14 |
| 23 | 11 | 5 | 4 | 1:0.45:0.36 | 20 |

[a]"Weight Percentage" is based on the total weight of the lubricant additive.
[b]These values are the weight percentage of the lubricant additive based on the total weight of the lubricant composition.
[c]"—" indicates that no concentration of this component was present in the lubricant additive.

TABLE IV

| Sample No. | Evaluation of Calcium-Based Lubricant Composition: Scar Diameter[b] (mm) |
|---|---|
| 12 | 1.84 |
| 13 | 1.83 |
| 14 | 1.78 |
| 15 | 1.89 |
| 16 | 1.69 |
| 17 | 1.66 |
| 18 | 1.66 |
| 19 | 1.63 |
| 20 | 1.85 |
| 21 | 1.89 |
| 22 | Weld[a] |
| 23 | Weld |

[a]"Weld" refers to a welding together of the four steel balls before the five-minute run was completed.
[b]"Scar Diameter" determined by modified ASTM procedure D 2596 wherein load force was 300 kg, speed was 1,800 rpm and testing time was 5 minutes.

It is appreciated from Table IV that blending $SbSbS_4$ with a mixture of $Sb_2O_3$ and $MoS_2$ produces synergistic results. Specifically, the Scar Diameter values of inventive Samples 12 and 13 were less than that of control Sample 20. Likewise, the Scar Diameter value of the inventive Sample 14 was less than that of control Sample 21. Finally, the Scar Diameter value of inventive Sample 16 was less than that of control Sample 22.

It is evident from the foregoing that various modifications can be made to the embodiments of this invention without departing from the spirit and scope thereof. Having thus described the invention, it is claimed as follows.

That which is claimed is:

1. A lubrication blend, having improved performance characteristics, consisting essentially of:

(a) at least one complex sulfide of antimony, represented by the formula:

$Sb_xS_y$ wherein, x is a number in the range from about 1.7 to about 2.3, and y is a number in the range from about 3.6 to about 4.4, (b) at least one antimony oxide, and (c) at least one lamellar crystalline solid lubricant.

2. A lubrication blend as in claim 1 wherein said complex sulfide of antimony comprises antimony thioantimonate.

3. A lubrication blend as in claim 1 wherein said antimony oxide comprises at least one antimony compound selected from the group consisting of antimony trioxide, antimony tetraoxide and antimony pentaoxide.

4. A lubrication blend as in claim 3 wherein said antimony oxide comprises antimony trioxide.

5. A lubrication blend as in claim 1 wherein the weight ratio between said complex sulfide of antimony and said antimony oxide is in the range from about 1:0.1 to about 1:10.

6. A lubrication blend as in claim 5 wherein the weight ratio between said complex sulfide of antimony and said antimony oxide is in the range from about 1:0.2 to about 1:8.

7. A lubrication blend as in claim 6 wherein the weight ratio between said complex sulfide of antimony and said antimony oxide or said compound convertible to an antimony oxide is in the range from about 1:0.3 to about 1:5.

8. A lubrication blend as in claim 1 wherein said lamellar crystalline solid lubricant comprises a compound selected from the group consisting of molybdenum disulfide, graphite, graphite fluoride, niobium diselenide, tungsten disulfide, tungsten diselenide, lead sulfide, lead oxide, calcium fluoride-barium fluoride eutectic mixtures, and mixtures thereof.

9. A lubrication blend as in claim 8 wherein said lamellar crystalline solid lubricant comprises graphite.

10. A lubrication blend as in claim 8 wherein said lamellar crystalline solid lubricant comprises molybdenum disulfide.

11. A lubrication blend, having improved performance characteristics, consisting essentially of:

(a) antimony thioantimonate, (b) antimony trioxide, wherein the weight ratio between said antimony thioantimonate and said antimony trioxide is in the range from about 1:0.3 to about 1:5, and (c) molybdenum disulfide.

12. A lubricant composition, having improved performance characteristics, comprising a lubricant base and a lubrication blend wherein said lubrication blend consists essentially of:

(a) at least one complex sulfide of antimony, represented by the formula:

$Sb_xS_y$ wherein, x is a number in the range from about 1.7 to about 2.3, and y is a number in the range from about 3.6 to about 4.4, (b) at least one antimony oxide, and (c) at least one lamellar crystalline solid lubricant.

13. A lubricant composition as in claim 12 wherein said lubricant base comprises a composition of matter selected from the group consisting of greases, mineral oils of lubricating viscosity, synthetic fluids of lubricating viscosity, solid lubricant resin binders, and mixtures thereof.

14. A lubricant composition as in claim 13 wherein said lubricant base comprises a grease selected from the group consisting of calcium-containing grease, lithium-containing grease, and mixtures thereof.

15. A lubricant composition as in claim 12 wherein the weight ratio of said lubricant base to said lubrication blend ranges from about 60:40 to about 99.97:0.03.

16. A lubricant composition as in claim 15 wherein said weight ratio of said lubricant base to said lubrication blend ranges from about 70:30 to about 99.85:0.15.

17. A lubricant composition as in claim 16 wherein said weight ratio of said lubricant base to said lubrication blend ranges from about 80:20 to about 99.7:0.3.

18. A lubricant composition as in claim 12 wherein said complex sulfide of antimony is present in an amount less than about 4, but greater than about 0.01 weight percent, said weight percent being based on the total weight of said lubricant composition.

19. A lubricant composition as in claim 18 wherein said complex sulfide of antimony is present in an amount from about 0.05 to about 3 weight percent.

20. A lubricant composition as in claim 19 wherein said complex sulfide of antimony is present in an amount from about 0.1 to about 2 weight percent.

21. A lubricant composition as in claim 12 wherein said antimony oxide is present in an amount ranging from about 0.01 to about 20 weight percent, said weight percent being based upon the total weight of said lubricant composition.

22. A lubricant composition as in claim 21 wherein said antimony oxide is present in an amount ranging from about 0.05 to about 15 weight percent.

23. A lubricant composition as in claim 22 wherein said antimony oxide is present in an amount ranging from about 0.1 to about 10 weight percent.

24. A lubricant composition as in claim 12 wherein said lamellar crystalline solid lubricant is present in an amount ranging from about 0.01 to about 20 weight percent, said weight percent being based on the total weight of said lubricant.

25. A lubricant composition as in claim 24 wherein said lamellar crystalline solid lubricant is present in an amount ranging from about 0.05 to about 18 weight percent.

26. A lubricant composition as in claim 25 wherein said lamellar crystalline solid lubricant is present in an amount ranging from about 0.1 to about 15 weight percent.

27. A lubricant composition comprising a lubricant base and a lubrication blend, said lubrication blend consisting essentially of:

(a) antimony thioantimonate, (b) antimony trioxide, wherein the weight ratio between said antimony thioantimonate and said antimony trioxide is in the range from about 1:0.3 to about 1:5, and (c) molybdenum disulfide, wherein, said lubricant base comprises a composition of matter selected from the group consisting of a calcium-containing grease, a lithium-containing grease, and mixtures thereof; the weight ratio of said lubricant base to said lubrication blend ranges from about 80:20 to about 99.7:0.3; said antimony thioantimonate is present in an amount ranging from about 0.1 to about 2 weight percent; said antimony trioxide is present in an amount ranging from about 0.1 to about 10 weight percent; and, said molybdenum disulfide is present in an amount ranging from about 0.1 to about 15 weight percent, said weight percentages being based on the total weight of said lubricant composition.

* * * * *